United States Patent [19]

Jacquet

[11] Patent Number: 4,742,190

[45] Date of Patent: May 3, 1988

[54] DEVICE FOR SELECTIVELY PREVENTING ONE OR MORE MODES OF ACTUATING MANUAL CONTROL MEMBERS EQUIPPING AN APPARATUS

[75] Inventor: Bruno Jacquet, Rueill Malmaison, France

[73] Assignee: La Telemecanique Electrique, France

[21] Appl. No.: 84,729

[22] Filed: Aug. 13, 1987

[30] Foreign Application Priority Data

Aug. 14, 1986 [FR] France ..... 8611736

[51] Int. Cl.[4] ..... H01H 9/22

[52] U.S. Cl. ..... 200/50 A; 200/18; 200/43.16; 337/73

[58] Field of Search ..... 335/26, 27; 337/72, 337/73 X; 200/18 X, 50 A, 293, 43.01, 43.11, 43.16 X, 43.17, 43.19, 43.22; 361/331, 334, 356, 357, 390, 392, 426; 312/223; 174/66; 74/3.52, 3.54, 3.56, 553, 554, 557

[56] References Cited

U.S. PATENT DOCUMENTS

| | | | |
|---|---|---|---|
| 3,018,341 | 1/1962 | Bassani | 200/50 A |
| 3,197,582 | 7/1965 | Norden | 200/50 A |
| 3,313,896 | 4/1967 | Gray | 200/50 A |
| 3,712,819 | 1/1973 | Field | 200/50 A |
| 4,074,091 | 2/1978 | Bischof | 200/50 A |

*Primary Examiner*—G. P. Tolin

*Attorney, Agent, or Firm*—William A. Drucker

[57] ABSTRACT

The invention provides a device for selectively preventing actuating modes of a manual control member equipping the face of the case of an apparatus and able to change over from a first position corresponding to a first function, to a second position corresponding to a second function and, from the first position to a third position corresponding to a third function. It includes a cover mounted for pivoting on the case and able to be applied against said face. This cover allows manual access to said member and includes means for allowing this member to change over from the first position to the third position and preventing it changing over from one to the other of the first and second positions.

7 Claims, 1 Drawing Sheet

DEVICE FOR SELECTIVELY PREVENTING ONE OR MORE MODES OF ACTUATING MANUAL CONTROL MEMBERS EQUIPPING AN APPARATUS

BACKGROUND OF THE INVENTION

The present invention relates to a device for selectively and/or partially preventing one or more modes of actuating manual control members equipping an apparatus.

It applies advantageously, but not exclusively, to apparatus of the overload relay type with manual and automatic reset generally called "manual-automataic reset thermal relays".

It will be recalled in this connection that a thermal relay is a protective apparatus associated with a contactor. Its purpose is to monitor the current flowing in the load (for example of a motor ), controlled by the contactor and to cause opening of this latter should an overload occur, that is to say for a current which may for example have a value between 1.05 and 1.2 times the nominal current of the load whose value is given by the constructor.

This relay generally includes thermally deformable bimetal elements heated by the current which flows through the load. From a certain threshold corresponding to an overload, these elements actuate a tripping device which controls the opening of a contactor.

After tripping, for bringing the load back into service, resetting can be achieved manually and/or automatically depending on whether it is a manual reset relay or a manual-automatic reset relay.

Usually, this latter type of relay has on one of the faces of the case, on the front face or on the upper face:

an adjustment knob for adjusting the protective device to the nominal current of the load controlled;

a knob for stopping the relay which acts on an opening contact; and a double acting knob, movable in rotation and in axial translation which has two angular positions for selecting the manual reset mode and the automatic reset mode and two axial positions, namely a normal rest position and a pushed-in position (with possible return under the effect of a spring) corresponding to resettng.

It proves in this type of apparatus, if sufficient precautions are not taken and if, during manual resetting, an action is performed both pushing and rotating the double acting knob, the initial choice of the reset mode can be accidently changed.

The invention has then more particularly as aim to overcome this type of disadvantage.

SUMMARY OF THE INVENTION

For this it generally provides a selective prevention device adapted to equip an apparatus housed in a case one of the faces of which includes at least one manual control member with multiple functions able to change over from a first position corresponding to a first function into a second position corresponding to a second function and, from one at least of these two positions, to a third position corresponding to a third function.

In accordance with the invention, this device more particularly includes a cover mounted for pivoting on said case so as to be applied in the closed down position against said face, this cover being formed so as to allow manual access to the actuating member and including means for causing this actuating member to change over from the first two positions to the third position, while preventing its change from one to the other of these first two positions.

Advantageously, said means equipping the cover may consist of foolproof means cooperating with corresponding foolproof means provided on the control member.

In one embodiment of the invention, the actuating member consists of a knob projecting from said face, this knob being rotatable between two angular positions and movable in translation along its rotational axis. In this case, the cover has a cut out of appropriate shape for letting the knob pass therethrough, whereas the shape of the knob is provided so as to cooperate with the edge of said cut out so that, in the closed down position of the lid, the knob cannot pass over from one angular position to the other while being moved in translation.

For this, said cut out and said knob may have, one at least a projecting shape and the other a re-entrant shape adapted to receive said projecting shape in one and/or the other of the two angular positions of the knob.

Of course, the lid may serve for preventing access to other actuating members of the apparatus by covering them. It may further include other recesses allowing selective access to a part only of the actuating members of the apparatus.

BRIEF DESCRIPTION OF THE DRAWINGS

Embodiments of the invention will be described hereafter by way of non limitative examples with reference to the accompanying drawings in which.

DESCRIPTION OF THE PREFERRED EMBODIMENTS

Figure 1:
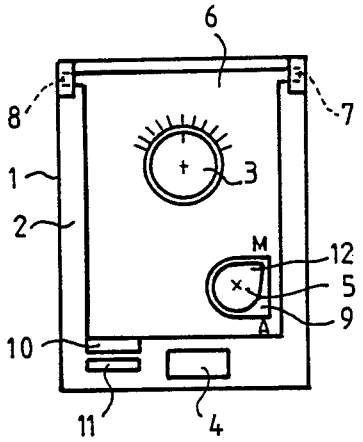
FIG. 1 is a view of the front (vertical) face of a relay equipped with a lid in accordance with the invention, in the closed down position.
Figure 2:
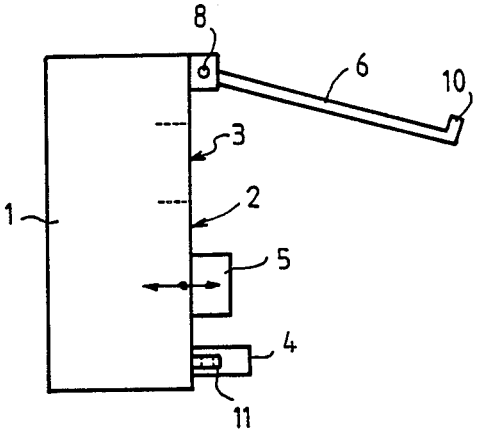
FIG. 2 is a side view of the relay shown in FIG. 1, with the lid partially open.

FIGS. 1 and 2 show schematically a thermal relay with "manual-automatic" resetting housed in a case 1 whose front vertical face 2 is provided with a current setting knob 3, stopping knob 4 and a selection/reset knob 5.

As can be seen in FIG. 1, the front face of the current setting knob 3 extends substantially in the plane of face 2. This knob 3 is movable in rotation and may include a slit for actuation thereof, for example by means of a screwdriver.

On the other hand, the stop knob 4 which is movable in translation, in the manner of a pusher, projects with respect to face 2.

The same goes for the selection-reset knob 5 which has two types of actuation, namely:

a first type of actuation by rotation for its changeover from an angular position M corresponding to the manual reset mode to an angular position A corresponding to the automatic reset mode, and a second type of actuation, by translation perpendicularly to face 2, in the manner of a pusher, which allows manual reset to be carried out when the manual reset mode has been selected.

Furthermore, the vertical face 2 of case 1 is provided with a transparent raisable lid 6, hinged to case 1 by means of trunnions 7 and 8 and which, in the closed down position, covers the current setting knob 3 while allowing this setting to be seen and giving access to the stop knob 4.

This lid 6 is further provided with an opening 9 for the passage of the selection/reset button 5, as well as a closure device 10 which cooperates with an homologous device 11 of the case for holding it in the closed down position and a sealing device, providing the inviolability of the closure.

In this example, the selection/reset knob 5, in the cylindrical part, has a foolproof shape, in this case an angular portion 12 projecting at 90°, whereas the opening 9 has a semicircular shape extended by a rectangular part whose two right angles correspond respectively to the two angular positions A and M of the knob. The width of the rectangular part is equal to the diameter of the semicircular shape and is slightly greater than the diameter of the knob, so that it is not possible for this latter to change over from one to the other of these two angular positions A, M without raising the cover 6.

Thus, selection of the automatic or manual reset mode may only be made with the cover raised as well moreover as the display of the current setting.

This foolproof device is such that when knob 5 is placed on M (manual mode) it is possible to press this knob 5 so as to obtain resetting without risking causing rotation thereof.

This device threfore allows the installer to set the current and the choice of reset mode during installation.

Once these choices are made, closure of the cover with possible sealing prevents any false manoeuver during resetting and interference from an unauthorized person.

Figure 3:
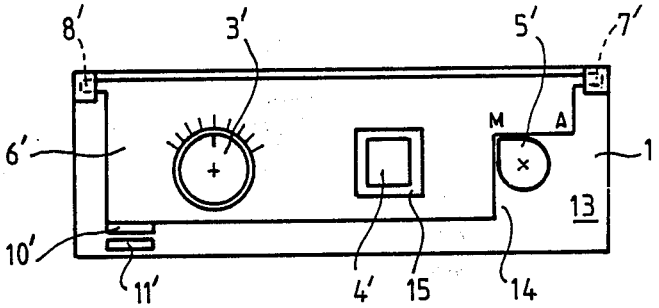
FIG. 3 is a top view of a relay whose upper face, carrying the operating and adjustment members, is equipped with a lid in accordance with the invention.

In the example shown in FIG. 3, the current setting knob 3', the stop knob 4' and the reset knob 5' are carried by the upper face 13 of case 1.

The reset knob 5' is identical to that shown in FIGS. 1 and 2. On the other hand, it does not pass through the cover 6' but cooperates for the foolproof feature with a cut out 14 forming a right angled re-entrant angular region.

In this example, cover 6' has an opening 15 through which the stop knob 4' passes.

Despite the slight difference, the method of using this device remains the same as that described above.

What is claimed is:

1. A device for selectively and/or partially preventing one or more actuating modes of at least one manual control member equipping one of the faces of the case of an apparatus, said member having multiple functions and being able to pass from a first position corresponding to a first function, to a second position corresponding to a second function and, from one at least of these two positions, to a third position corresponding to a third function, which device includes a cover mounted for pivoting on said case so as to be applied in the closed down position against said face, this cover being formed so as to allow manual access to the control member and including means for allowing this control member to change over from the first two positions to the third position, while preventing it from changing over from one to the other of these first two positions.

2. The device as claimed in claim 1, wherein said means equipping the cover consist of foolproof means cooperating with corresponding foolproof means provided on the control member.

3. The device as claimed in claim 1, wherein said control member consists of a knob projecting from said face, this knob being rotatable between two angular positions and movable in translation along its rotational axis, wherein said cover has a cut out of appropriate shape for letting said knob pass therethrough, whereas the shape of the knob is provided so as to cooperate with the edge of said cut out so that in the closed down position of the cover, the knob may not change over from one angular position to the other while being able to be moved in translation.

4. The device as claimed in claim 3, wherein said cut out and said knob include, one at least a projecting shape and the other at least a re-entrant shape adapted for receiving said projecting shape in one and/or the other of the two angular positions of said knob.

5. The device as claimed in claim 1, wherein said apparatus includes, in addition to said control member, other actuation members, wherein said cover further includes at least one other recess for allowing selective access to said actuating members.

6. The device as claimed in claim 1, including means for locking the cover on the case of the apparatus, in the closed down position of said cover.

7. The device as claimed in claim 6, wherein said locking means include a sealing device.

* * * * *